US008842869B2

(12) United States Patent
Kim

(10) Patent No.: US 8,842,869 B2
(45) **Date of Patent: *Sep. 23, 2014**

(54) METHOD AND APPARATUS FOR SOUND SOURCE LOCALIZATION USING MICROPHONES

(75) Inventor: Hyun Soo Kim, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/454,384

(22) Filed: Apr. 24, 2012

(65) Prior Publication Data

US 2012/0207323 A1 Aug. 16, 2012

Related U.S. Application Data

(63) Continuation of application No. 12/262,303, filed on Oct. 31, 2008, now Pat. No. 8,184,843.

(30) Foreign Application Priority Data

Oct. 31, 2007 (KR) ..... 10-2007-0110363

(51) Int. Cl.
*H04R 3/00* (2006.01)
*H04R 9/08* (2006.01)
*H04R 1/40* (2006.01)

(52) U.S. Cl.
CPC ..... *H04R 1/406* (2013.01); *H04R 2201/401* (2013.01)
USPC ..... 381/356; 381/92

(58) Field of Classification Search
CPC .. H04R 3/005; H04R 2201/401; H04R 1/406; H04R 25/407
USPC ..... 367/117; 381/26, 56, 58, 356–358, 170
See application file for complete search history.

(56) References Cited

U.S. PATENT DOCUMENTS

| | | | | |
|---|---|---|---|---|
| 6,243,471 | B1 * | 6/2001 | Brandstein et al. | 381/92 |
| 7,394,907 | B2 | 7/2008 | Tashev | |
| 8,184,843 | B2 * | 5/2012 | Kim | 381/356 |
| 2004/0175006 | A1 | 9/2004 | Kim et al. | |
| 2004/0240680 | A1 * | 12/2004 | Rui et al. | 381/92 |

FOREIGN PATENT DOCUMENTS

| | | | |
|---|---|---|---|
| JP | 2004-325284 | A | 11/2004 |
| JP | 2005-208166 | A | 8/2005 |
| JP | 2009-222352 | A | 10/2009 |
| KR | 10-2004-0079085 | A | 9/2004 |

* cited by examiner

*Primary Examiner* — Michelle Mandala
*Assistant Examiner* — Raj R Gupta
(74) *Attorney, Agent, or Firm* — Cha & Reiter, LLC

(57) ABSTRACT

A method and apparatus for sound source localization using microphones are disclosed. The method includes: receiving signals coming from a sound source through microphones covering all directions; distinguishing the received signals into those signals directly input to the microphones from the sound source (direct signals) and those signals indirectly input to the microphones (indirect signals); identifying a candidate region at which the sound source is present using locations of the microphones receiving direct signals; selecting a point in the candidate region as a candidate location; drawing one or more virtual tangent lines, contacting with the circumference of the apparatus, from the candidate location; placing locations of the microphones receiving indirect signals on the virtual tangent lines; and localizing the sound source on the basis of signals passing through the microphones receiving direct signals and through the virtual locations of the microphones receiving indirect signals.

20 Claims, 5 Drawing Sheets

METHOD AND APPARATUS FOR SOUND SOURCE LOCALIZATION USING MICROPHONES

CLAIM OF PRIORITY

The present application is a Continuation of U.S. patent application Ser. No. 12/262,303 filed on Oct. 31, 2008 which claims the benefit of the earlier filing date, pursuant to 35 USC 119, to that patent application entitled "METHOD AND APPARATUS FOR SOUND SOURCE LOCALIZATION USING MICROPHONES" filed in the Korean Intellectual Property Office on Oct. 31, 2007 and assigned Serial No. 2007-0110363, the contents of which are incorporated herein by reference.

BACKGROUND OF THE INVENTION

1. Field of the Invention

The present invention relates generally to sound source localization and, more particularly, to a method and apparatus for sound source localization wherein a sound source is localized using both microphones directly receiving sound signals from the source and microphones indirectly receiving sound signals.

2. Description of the Related Art

Microphones can be used in various ways according to their placement. For example, in sound enhancement, a microphone is used to amplify sound originating only from a particular speaker or position. In sound source localization, when a speaker talks, a microphone is used to locate the speaker. In source separation, when a number of speakers simultaneously talk, a microphone is used to separate the sound of a particular speaker from other sounds. In particular, active research has been conducted in sound source localization and its application.

Techniques for sound source localization are based on time difference of arrival (TDOA) estimation, on a steered beamformer delaying and summing individual signals captured by multiple microphones, or on high-resolution spectral estimation.

Localization accuracy is a very important performance measure in sound source localization employing an array of microphones. Performance of sound source localization depends upon the characteristics of the microphones, the number of microphones, their arrangement, the level of noise and reverberation, and the number of talking speakers.

High-quality and multiple microphones can heighten localization performance, and a high level of noise and reverberation can lower localization performance. Localization performance can be heightened through arranging microphones in a manner suitable for an application, and localization performance can be lowered with an increased number of talking speakers because of increased ambiguity.

Whereas a large number of microphones can lead to good localization performance, the number of installable microphones may be limited in some cases. Thus, it is necessary to provide a high-performance sound source localization technique employing a small number of microphones.

SUMMARY OF THE INVENTION

The present invention provides a method and apparatus for sound source localization that produce high localization accuracy through effective utilization of a small number of microphones.

In accordance with an exemplary embodiment of the present invention, there is provided a sound source localization method, using a sound source localization apparatus having microphones covering all directions, including: receiving signals coming from a sound source through one or more of the microphones; distinguishing the received signals into those signals directly input to the microphones from the sound source (direct signals) and those signals indirectly input to the microphones from the sound source (indirect signals); identifying a candidate region at which the sound source is present using locations of the microphones receiving direct signals; selecting a point in the candidate region as a candidate location of the sound source; drawing one or more virtual tangent lines, contacting with the circumference of the sound source localization apparatus, from the candidate location; placing locations of the microphones receiving indirect signals on the virtual tangent lines; and localizing the sound source on the basis of signals passing through the microphones receiving direct signals and through the virtual locations of the microphones receiving indirect signals.

In accordance with another exemplary embodiment of the present invention, there is provided a sound source localization apparatus including: one or more microphones covering all directions, and receiving signals coming from a sound source; signal selector distinguishing the received signals into those signals directly input to the microphones from the sound source (direct signals) and those signals indirectly input to the microphones from the sound source (indirect signals); a first localizing unit identifying a candidate region at which the sound source is present using locations of the microphones receiving direct signals; and a second localizing unit selecting a point in the candidate region as a candidate location of the sound source, drawing, from the candidate location, one or more virtual tangent lines contacting with the circumference of the sound source localization apparatus, placing locations of the microphones receiving indirect signals on the virtual tangent lines, and localizing the sound source on the basis of signals passing through the microphones receiving direct signals and through the virtual locations of the microphones receiving indirect signals.

In the sound source localization method and apparatus of the present invention, a candidate region at which a sound source is present is selected first, and then the sound source is accurately localized within the candidate region. Hence, compared with existing localization systems that localize a sound source in a neighboring region, the computation time and computation steps can be reduced.

In addition, for sound source localization, those microphones indirectly receiving a sound signal from a sound source are assumed to be located at virtual positions where the sound signal can be directly received. Hence, even when surrounding environment or external objects block the direct propagation path of the sound signal, all the microphones can be used for TDOA estimation, increasing localization accuracy.

BRIEF DESCRIPTION OF THE DRAWINGS

The features and advantages of the present invention will be more apparent from the following detailed description in conjunction with the accompanying drawings, in which.

DETAILED DESCRIPTION OF THE INVENTION

Exemplary embodiments of the present invention are described in detail with reference to the accompanying drawings. The same reference symbols are used throughout the drawings to refer to the same or like parts. Detailed descriptions of well-known functions and structures incorporated herein may be omitted to avoid obscuring the subject matter of the present invention. Particular terms may be defined to describe the invention in the best manner. Accordingly, the meaning of specific terms or words used in the specification and the claims should not be limited to the literal or commonly employed sense, but should be construed in accordance with the spirit of the invention. The description of the various embodiments is to be construed as exemplary only and does not describe every possible instance of the invention. Therefore, it should be understood that various changes may be made and equivalents may be substituted for elements of the invention.

Figure 1A:
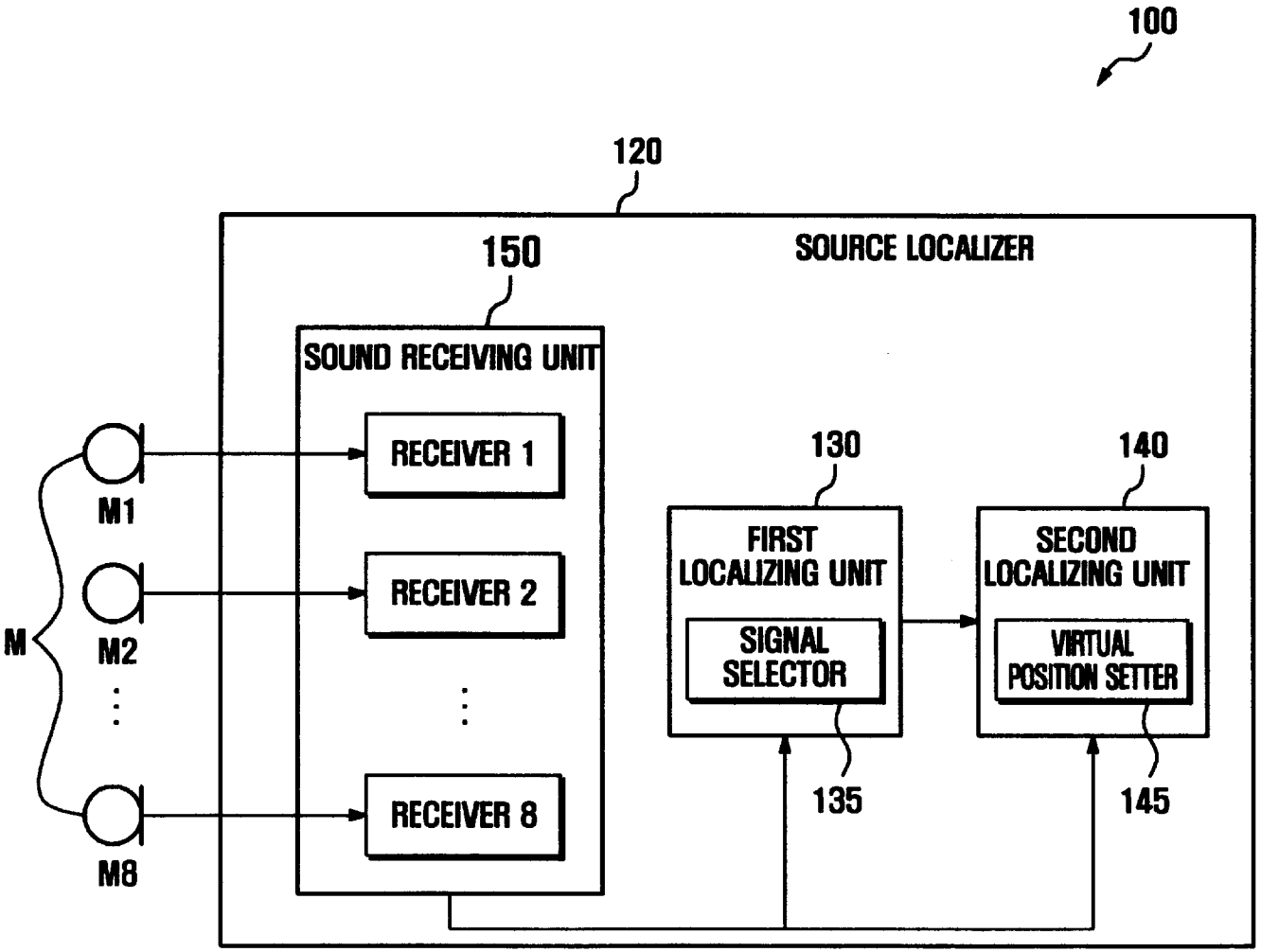
FIGS. 1A and 1B are diagrams illustrating a sound source localization apparatus according to an exemplary embodiment of the present invention.
Figure 1B:
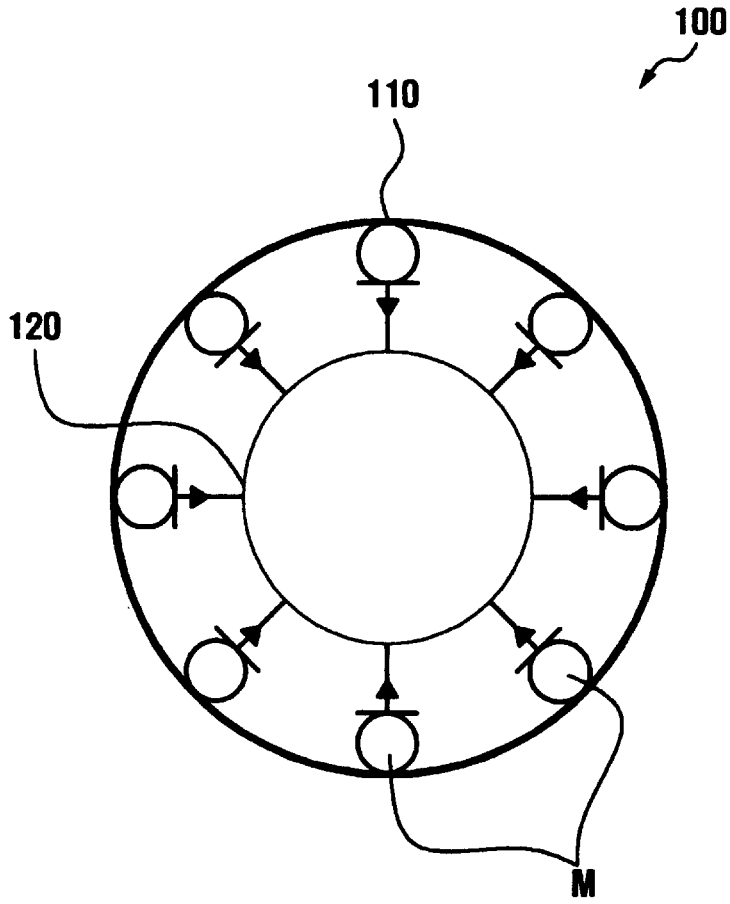

FIG. 1A is a block diagram illustrating a sound source localization apparatus 100 according to an exemplary embodiment of the present invention, and FIG. 1B is a sectional view of the apparatus 100.

Referring to FIGS. 1A and 1B, the sound source localization apparatus 100 includes a plurality of microphones M installed along the circumference of case 110, and a source localizer 120 to localize a sound source using signals through the microphones M. The source localizer 120 includes a sound receiving unit 150, first localizing unit 130, and second localizing unit 140.

The microphones M are installed around the periphery of the sound source localization apparatus 100. In the present embodiment, it is assumed that the sound source is localized in a two-dimensional space. Hence, as illustrated in FIG. 1B, eight microphones M are placed on the same plane. The microphones M may also be placed in a three-dimensional space. In this case, the microphones M can be placed on a plane perpendicular to the plane in FIG. 1B. The microphones M capture a sound signal originating from a sound source. In the present embodiment, the microphones M are omnidirectional microphones, which produce output voltages that are proportional to sound pressure levels regardless of source directions, covering all directions. However, unidirectional microphones, each being sensitive to sounds from only one direction, may also be used. Further, omnidirectional and unidirectional microphones may be alternately placed. In the present invention, signals captured by multiple microphones are used together. Hence, use of microphones with a high signal-to-noise ratio, wide intervals between microphones, and use of a large number of microphones contribute to obtaining more accurate results.

The sound receiving unit 150 includes one or more receivers (receiver 1 to receiver 8). The receivers receive signals from the corresponding microphones M. The sound receiving unit 150 sends the received signals to the first localizing unit 130 and second localizing unit 140.

The first localizing unit 130 identifies a candidate region at which a sound source is present (block) on the basis of signals directly input to the microphones M (direct signals) without reflection or diffraction. Thereto, the first localizing unit 130 includes a signal selector 135 to extract direct signals from those signals collected through the sound receiving unit 150. The first localizing unit 130 identifies the block at which the sound source is present using only direct signals through steered response power (SRP) source localization (finding the location exhibiting the greatest steered power in a search space) or search space clustering. That is, the first localizing unit 130 identifies the block at which the sound source is present using only direct signals with indirect signals excluded.

To accurately identify the block at which the sound source is present, the first localizing unit 130 subdivides the surrounding space into multiple blocks.

Figure 2:
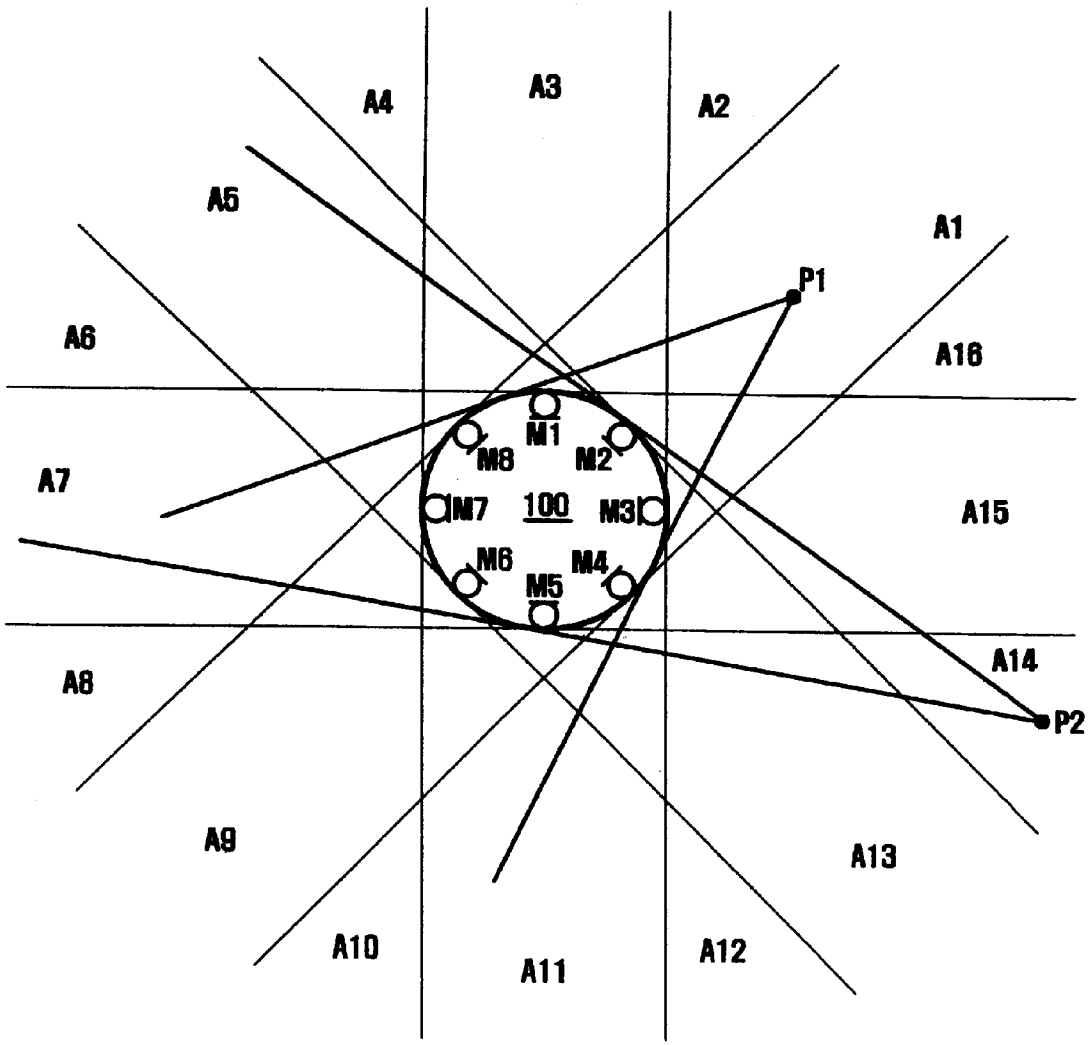
FIG. 2 illustrates localization blocks around the apparatus of FIG. 1.

FIG. 2 illustrates blocks around the sound source localization apparatus 100. As illustrated in FIG. 2, the first localizing unit 130 subdivides the surrounding space into multiple blocks A1 to A16, and selects one of the blocks at which the sound source is considered to be located.

The second localizing unit 140 accurately localizes the location of the sound source using both signals indirectly input to the microphones M (indirect signal) and direct signals. Thereto, the second localizing unit 140 includes a virtual position setter 145 to set virtual positions of those microphones M receiving indirect signals. The second localizing unit 140 localizes the location of the sound source within the block selected by the first localizing unit 130. This contributes to reduction of the computation time and number of steps in comparison to existing techniques in which the sound source is localized over the whole surrounding space. The second localizing unit 140 computes time differences of arrival between signals input to the microphones M, and localizes the location of the sound source using combinations of time differences of arrival.

Next, a sound source localization method is described. The configuration of the sound source localization apparatus 100 will be more apparent through this description.

Figure 3:
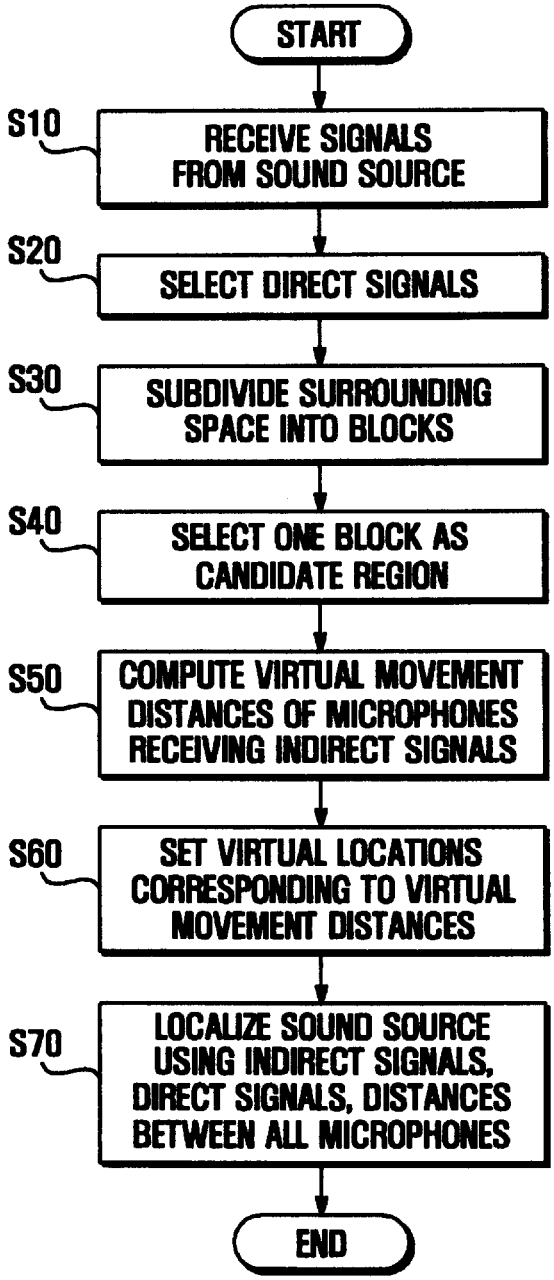
FIG. 3 is a flow chart illustrating a sound source localization method according to another exemplary embodiment of the present invention.
Figure 4A:
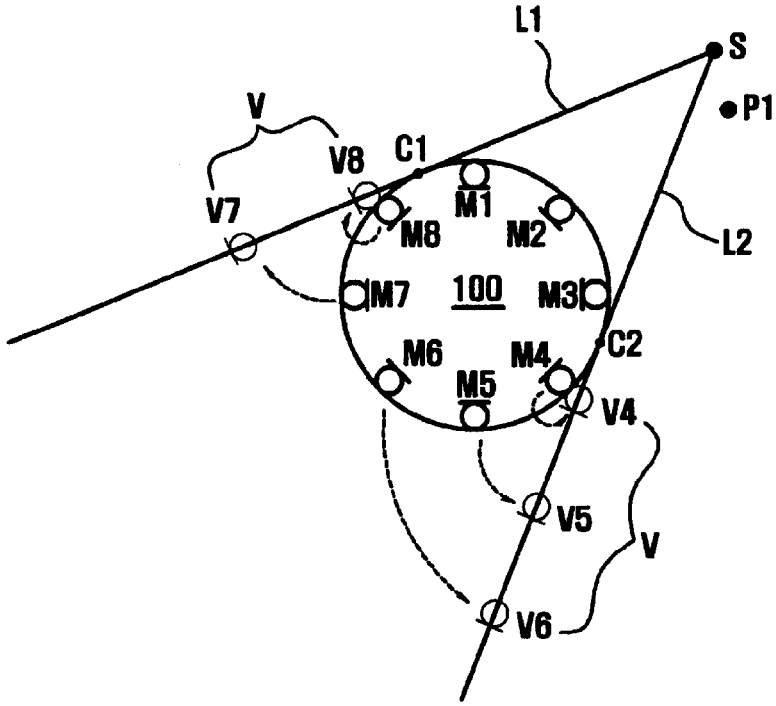
FIGS. 4A and 4B illustrate setting of virtual locations of microphones.
Figure 4B:
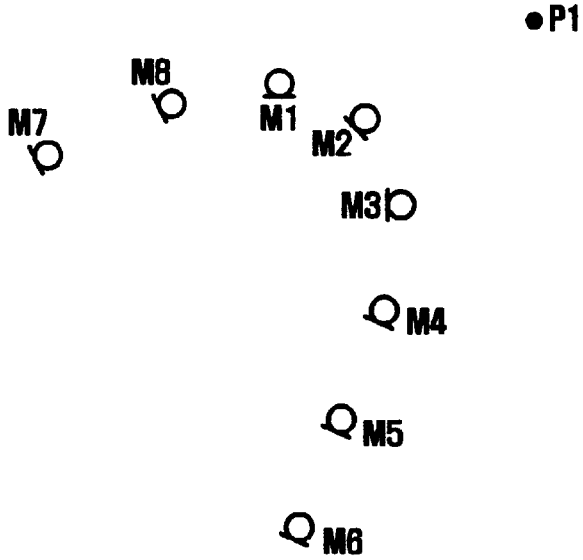

FIG. 3 is a flow chart illustrating a sound source localization method according to another exemplary embodiment of the present invention. FIGS. 4A and 4B illustrate setting of virtual locations of microphones.

Referring to FIGS. 4A to 4B, each of the microphones M receives sound signals generated by a sound source (S10). The signals are input to the microphones M of the sound source localization apparatus 100. To be more specific, when the sound source is P1 in FIG. 2, the microphones M1, M2 and M3 directly receive signals from the sound source P1. The microphones M4, M5, M6, M7 and M8, not facing the sound source P1, indirectly receive signals. When the sound source is P2 in FIG. 2, the microphones M2, M3, M4 and M5 directly receive signals from the sound source P2. The microphones M1, M6, M7 and M8, not facing the sound source P2, indirectly receive signals. Indirectly-received signals refer to signals that have been diffracted behind the sound source localization apparatus 100 or reflected by the surrounding environment.

Thereafter, direct signals are selected from the signals received by the microphones M (S20). In this step, the signal selector 135 of the first localizing unit 130 determines the microphones receiving direct signals by comparing the magnitudes of the received signals to each other or by computing time differences of arrival between the received signals. After selection of microphones receiving direct signals, the first localizing unit 130 can determine which microphones M have received direct signals. In the case of the sound source P1 (FIG. 2), the microphones M1, M2 and M3 are determined to receive direct signals from the sound source P1. Through selection of direct signals, the first localizing unit 130 recognizes that the microphones M1, M2 and M3 have received direct signals and the microphones M4, M5, M6, M7 and M8 have received indirect signals. In the case of the sound source P2 (FIG. 2), the microphones M2, M3, M4 and M5 receive direct signals. Through selection of direct signals, the first localizing unit 130 recognizes that the microphones M2, M3, M4 and M5 have received direct signals and the microphones M1, M6, M7 and M8 have received indirect signals. As would be recognized, the microphones determined to receive direct signals are those microphones receiving signals within a known tolerance of a selected microphone. For example, microphones having a signal amplitude within a known tolerance value of the microphone having a maximum signal amplitude may be deemed to have received a direct signal. The remaining microphones are deemed to receive indirect signals. Similarly, microphone having a signal time of arrival within a known tolerance of that microphone having the earliest, in time, received signal may be deemed having received a direct signal.

For the purpose of description, the sound source is assumed to be P1 (in FIG. 2).

Thereafter, the first localizing unit 130 identifies a candidate region at which the sound source P1 is present using the selected direct signals. Thereto, the first localizing unit 130 subdivides the surrounding space around the sound source localization apparatus 100 into 16 blocks (S30). Here, the surrounding space is subdivided into 16 blocks only for the purpose of description, and may be subdivided into a larger number of blocks.

Subdivision of the surrounding space at step S30 may be performed before selection of direct signals at step S20, and may be preset by the user.

The first localizing unit 130 selects one of the blocks at which the sound source is considered to be located, as the candidate region (S40). After analysis of all received signals and selection of direct signals, the first localizing unit 130 determines that the microphones M1, M2 and M3 have received direct signals. Accordingly, the first localizing unit 130 selects the block A1 as the candidate region among the 16 blocks. In the case when the microphones M2, M3, M4 and M5 were to have received direct signals, the first localizing unit 130 would select the block A14 as the candidate region.

After selection of the block A1 as the candidate region, the second localizing unit 140 accurately localizes the location of the sound source in subsequent steps S50 to S70.

For accurate source localization, it is assumed that those microphones M receiving indirect signals are moved to their virtual locations and they then receive direct signals. Hence, a procedure is performed to set virtual locations for the microphones M receiving indirect signals.

As illustrated in FIG. 4A, the virtual position setter 145 of the second localizing unit 140 sets virtual locations V of the microphones M4, M5, M6, M7 and M8 receiving indirect signals. Thereto, the virtual position setter 145 computes virtual movement distances of the microphones M4, M5, M6, M7 and M8 receiving indirect signals (S50).

In the present embodiment, virtual locations V are on two tangent lines L1 and L2 drawn from the central point S of the block A1, selected by the first localizing unit 130, to contact with the sound source localization apparatus 100. The virtual locations V are formed, from the central point S (start point), after the contact points C1 and C2 between the tangent lines L1 and L2 and the sound source localization apparatus 100. In the case of FIG. 2, the block A1 is selected by the first localizing unit 130, and most virtual locations V are formed in the blocks A7 to A11 opposite to the block A1 (after the contact points). The virtual position setter 145 forms a virtual location V on one of the tangent lines L1 and L2 closer to the corresponding microphone M. The microphone M7 is closer to the tangent line L1 than L2, and hence the virtual location V7 thereof is on the tangent line L1. Likewise, the microphone M6 is closer to the tangent line L2 than L1, and the virtual location V6 thereof is on the tangent line L2. When the distances from a microphone M to the tangent line L1 and to the tangent line L2 are the same, the virtual location can be on any one of the tangent lines L1 and L2. In one aspect of the invention, those microphones having the same distance from tangent line L1 and L2 may be alternately assigned to tangent lines L1 and L2.

In addition, the position of a virtual location V depends on the distance between the corresponding microphone M and contact point C1 or C2. In the present embodiment, the virtual locations V are formed at some distances from the contact point C1 or C2. The distance between a virtual location V and the contact point C1 or C2 is equal to the distance between the corresponding microphone M and contact point C1 or C2. Here, the distance between a microphone M and the contact point C1 or C2 is not the linear distance but the travel distance around the circumference of the sound source localization apparatus 100, and corresponds to the travel distance of a signal from the contact point C1 or C2 around the circumference of the sound source localization apparatus 100. Hence, the arc length from the contact point C1 on the tangent line L1 to the microphone M7 becomes the distance between the contact point C1 and virtual location V7. Likewise, the arc length from the contact point C2 on the tangent line L2 to the microphone M6 becomes the distance between the contact point C2 and virtual location V6.

As described above, the virtual position setter 145 computes distances between the contact point C1 or C2 and the microphones M4, M5, M6, M7 and M8 receiving indirect signals (S50), and sets virtual locations V of the microphones M4, M5, M6, M7 and M8 using the tangent lines L1 and L2 and contact points C1 and C2 (S60).

Thereafter, the second localizing unit 140 accurately localizes the sound source P1 (S70). The second localizing unit 140 localizes the sound source P1 within the block A1 selected at step S30. This contributes to reduction of the computation time and number of steps to localize the sound source in comparison to existing techniques in which the sound source is localized over the whole surrounding space.

The second localizing unit 140 localizes the sound source P1 on the basis of the virtual locations V of the microphones M4 to M8 receiving indirect signals, distances between the microphones M1 to M3, magnitudes of signals input to the microphones M, and time differences of arrival of the signals. That is, under the assumption that the microphones M are arranged as shown in FIG. 4B and all the microphones M directly receive the signal from the sound source P1, the second localizing unit 140 localizes the sound source P1. Hence, a larger number of microphones are used for source localization, leading to more accurate localization.

The second localizing unit 140 computes time differences of arrival between signals due to distances between the microphones M, and localizes the sound source P1 at the candidate region using combinations of time differences of arrival. Source localization at this step may be performed through other known techniques utilizing steered beamforming or high-resolution spectral estimation.

As apparent from the above description, for sound source localization, those microphones indirectly receiving signals from the sound source are assumed to be located at virtual locations where signals from the sound source can be directly received. Hence, even when surrounding environment or external objects block the direct propagation path of sound signals, all the microphones can be used for TDOA estimation, increasing source localization accuracy. In particular, use of steered response power (SRP) localization can enhance the signal-to-noise ratio (SNR) of beamformed signals, leading to enhancement of localization performance.

The sound source localization apparatus of the present invention includes microphones covering all directions. Direct signals and indirect signals are captured together regardless of source directions. Hence, the sound source can be readily localized without change of direction.

The scope of the present invention is not limited to the described embodiments. The method and apparatus for sound source localization can be modified in various ways. For example, in the description, eight microphones are used for source localization. If necessary, any number of microphones may be placed at various intervals for localization.

In the description, sound source localization is performed in a two-dimensional space. If microphones are arranged so as to cover all directions in a three-dimensional space, sound source localization can be performed in a three-dimensional space.

In the description, the first localizing unit selects a single candidate region. Multiple candidate regions can also be selected. When multiple candidate regions are selected, the second localizing unit sets virtual locations of microphones for each candidate region, localizes the location of the sound source for each candidate region, and selects one of the locations with the highest reliability as the source location.

In the description, the sound source localization apparatus has a circular section device to install microphones. Any device that can accommodate microphones covering all directions may be also used.

The above-described methods according to the present invention can be realized in hardware or as software or computer code that can be stored in a recording medium such as a CD ROM, an RAM, a floppy disk, a hard disk, or a magneto-optical disk or downloaded over a network, so that the methods described herein can be rendered in such software using a general purpose computer, or a special processor or in programmable or dedicated hardware, such as an ASIC or FPGA. As would be understood in the art, the computer, the processor or the programmable hardware include memory components, e.g., RAM, ROM, Flash, etc. that may store or receive software or computer code that when accessed and executed by the computer, processor or hardware implement the processing methods described herein.

Although exemplary embodiments of the present invention have been described in detail hereinabove, it should be understood that many variations and modifications of the basic inventive concept herein described, which may appear to those skilled in the art, will still fall within the spirit and scope of the exemplary embodiments of the present invention as defined in the appended claims.

What is claimed is:

1. A sound source localization apparatus comprising:

plural microphones receiving signals coming from a sound source;

a first localizing unit identifying a region at which the sound source is present using direct signals from the sound source directly input to the microphones; and a second localizing unit setting virtual locations of the microphones receiving indirect signals propagated from the identified region and accurately localizing the sound source within the region using the set virtual locations and the indirect signals from the sound source indirectly input to the microphones.

2. The sound source localization apparatus of claim 1, wherein each of the microphones is placed in one of at least four cardinal directions of a two-dimensional space around the sound source localization apparatus.

3. The sound source localization apparatus of claim 2, wherein the first localizing unit subdivides the surrounding space around the sound source localization apparatus into multiple blocks, and selects one of the blocks at which the sound source is considered to be located, as the identified region.

4. The sound source localization apparatus of claim 3, wherein the first localizing unit identifies the region using at least one of time difference of arrival estimation, steered beamforming, or high-resolution spectral estimation.

5. The sound source localization apparatus of claim 4, wherein the second localizing unit accurately localizes the sound source assuming that each of the microphones receiving the indirect signals is placed at a respective one of the virtual locations.

6. The sound source localization apparatus of claim 5, wherein the virtual locations are formed on two tangent lines from the central point of the identified region to contact with the sound source localization apparatus.

7. The sound source localization apparatus of claim 6, wherein the virtual locations are formed on the tangent lines in the direction opposite to the identified region with respect to contact points between the tangent lines and the sound source localization apparatus.

8. The sound source localization apparatus of claim 7, wherein the distance between a virtual location and its associated contact point is set to be equal to the distance between the corresponding microphone and the contact point.

9. The sound source localization apparatus of claim 8, wherein the second localizing unit computes time differences of arrival between signals input to all the microphones, and localizes the sound source using combinations of the time differences of arrival.

10. A sound source localization apparatus comprising:

plural microphones receiving signals coming from a sound source;

a first localizing unit identifying a candidate region at which the sound source is present using direct signals from the sound source directly input to the microphones; and a second localizing unit accurately localizing the sound source within the candidate region using indirect signals from the sound source indirectly input to the microphones;

wherein the second localizing unit sets virtual locations of the microphones receiving the indirect signals propagated in accordance with the candidate region, and accurately localizes the sound source assuming that each of the microphones receiving the indirect signals is placed at a respective one of the virtual locations.

11. The sound source localization apparatus of claim 10, wherein the virtual locations are formed on two tangent lines from the central point of the candidate region to contact with the sound source localization apparatus.

12. The sound source localization apparatus of claim 11, wherein the virtual locations are formed on the tangent lines in the direction opposite to the candidate region with respect to contact points between the tangent lines and the sound source localization apparatus.

13. The sound source localization apparatus of claim 12, wherein the distance between a virtual location and its associated contact point is set to be equal to the distance between the corresponding microphone and the contact point.

14. The sound source localization apparatus of claim 13, wherein the second localizing unit computes time differences of arrival between signals input to all the microphones, and localizes the sound source using combinations of the time differences of arrival.

15. A method operable in a sound source localization apparatus having plural microphones, comprising:

receiving, by the microphones, signals coming from a sound source;

identifying a region at which the sound source is present using direct signals from the sound source directly input to the microphones;

setting virtual locations of the microphones receiving indirect signal propagated from the identified region; and accurately localizing the sound source within the region using the set virtual locations and the indirect signals from the sound source indirectly input to the microphones.

16. The method of claim 15, wherein identifying a region comprises:

subdividing the surrounding space around the sound source localization apparatus into multiple blocks; and selecting one of the blocks at which the sound source is considered to be located, as the identified region.

17. The method of claim 16, wherein selecting one of the blocks as the identified region is performed using at least one of time difference of arrival estimation, steered beamforming, or high-resolution spectral estimation.

18. The method of claim 17, wherein accurately localizing the sound source comprises:

setting virtual locations of the microphones receiving the indirect signals propagated from the identified region; and accurately localizing the sound source assuming that each of the microphones is placed at a respective one of the virtual locations.

19. The sound source localization method of claim 18, wherein the virtual locations are formed on two tangent lines from a central point of the identified region to contact with the sound source localization apparatus.

20. A non-transitory computer-readable storage medium having stored therein program instructions, which when executed by a processor, perform the method of claim 15.

* * * * *